US005786672A

United States Patent [19]

Date et al.

[11] Patent Number: 5,786,672

[45] Date of Patent: Jul. 28, 1998

[54] DEFLECTION APPARATUS FOR CATHODE RAY TUBE

[75] Inventors: Takahiko Date, Omiya; Hiromichi Arai, Kumagaya; Kimiyoshi Nishizawa, Honjo, all of Japan

[73] Assignee: Kabushiki Kaisha Toshiba, Kawasaki, Japan

[21] Appl. No.: 807,947

[22] Filed: Feb. 28, 1997

[30] Foreign Application Priority Data

Feb. 29, 1996 [JP] Japan ..... 8-043120

[51] Int. Cl.[6] ..... G09G 1/28; H01J 29/56

[52] U.S. Cl. ..... 315/368.26; 315/370

[58] Field of Search ..... 315/368.25, 368.26, 315/368.28, 370, 399; 313/426, 440

[56] References Cited

U.S. PATENT DOCUMENTS 3,631,296 12/1971 Collie, Jr. ..... 315/368.25

4,899,082 2/1990 Sands et al. ..... 315/370

5,036,246 7/1991 Germani ..... 313/440

*Primary Examiner*—Gregory C. Issing

*Attorney, Agent, or Firm*—Cushman Darby & Cushman IP Group of Pillsbury Madison & Sutro, LLP

[57] ABSTRACT

A deflection apparatus arranged on the outer circumference of a funnel of a cathode ray tube includes a deflection yoke having vertical deflection coils and horizontal deflection coils. A compensation coil is provided on the outer circumference of a front end opening portion of the deflection yoke. An electrostatic capacitance element is connected between both end terminals of the compensation coil. The capacity of the electrostatic capacitance element is set such that an inducing voltage generated between both end terminals of the compensation coil is equal to or lower than a predetermined value.

4 Claims, 4 Drawing Sheets

DEFLECTION APPARATUS FOR CATHODE RAY TUBE

BACKGROUND OF THE INVENTION

The present invention relates to a deflection apparatus for a cathode ray tube, and particularly to a deflection apparatus comprising a compensation coil for compensating convergence shifts of a plurality of electron beams and landing shifts of beams on a phosphor layer.

In general, a color cathode ray tube comprises a vacuum envelope having a face panel and a funnel. An electron gun assembly is provided in a neck portion of the funnel. Three electron beams emitted from the electron gun assembly are deflected by horizontal and vertical deflection magnetic fields generated by a deflection yoke provided outside the area of a boundary between the neck portion and a large diameter portion of the funnel. The deflected beams horizontally and vertically scan, through a shadow mask, a phosphor screen formed on the inner surface of the face panel to display a color image is displayed on the phosphor screen.

In this kind of color cathode ray tube, a raster imaged on the phosphor screen and landing positions of three electron beams with respect to the three color phosphor layers are rotationally shifted due to earth magnetism. In order to adjust those rotational shifts of the raster and landing positions, a compensation coil is provided in the vicinity of an opening portion of the front or rear end of the deflection yoke. When the cathode ray tube is installed in the housing of the monitor apparatus, both ends of the compensation coil are connected to a compensation current supply circuit of the monitor apparatus.

If a color cathode ray tube in which the raster and landing of three electron beams are properly adjusted with respect to the three color phosphor layers is subject to earth magnetism along the tube axis from its back side to its front side, the raster and the landing positions of three electron beams are rotated and shifted in the counter-clockwise direction, with respect to the corresponding three color phosphor layers. Likewise, if a properly adjusted color cathode ray tube is subject to earth magnetism along the tube axis from its front side to its back side, the raster and landing positions of three electron beams are rotated and shifted in the clockwise direction.

Therefore, in a monitor apparatus equipped with a deflection yoke having an above-mentioned compensation coil, a compensation current (direct current) is supplied to the compensation coil to generate a magnetic field so that a compensation force is applied to three electron beams in correspondence with the direction and the current amount of the compensation current flowing through the compensation coil (according to Fleming's rule). Rotational shifts of the raster and landing position caused by the tube axis direction component of magnetism are thus compensated.

During manufacturing inspection of a color cathode ray tube, a special adjustment apparatus is used, in place of a compensation current supply circuit of a monitor apparatus, to adjust convergence and landing position of three electron beams with respect to the color phosphor layers to attain high manufacturing efficiency. However, if a color cathode ray tube equipped with a deflection yoke having a compensation coil is installed in a monitor apparatus and rotational shifts of raster and landing positions are adjusted as has been described above, compensated conditions may differ from those obtained by adjusting convergence and landing with use of a special adjustment apparatus during manufacturing inspections a color cathode ray tube.

More specifically, the compensation coil has a transconductance M between the horizontal deflection coil and the vertical deflection coil of the deflection yoke, a reactance L, a resistance R, and a capacitance C, and therefore causes a resonance with a deflection magnetic field generated by the deflection yoke, thereby slightly changing the deflection magnetic field. Further, when the cathode ray tube is installed in a monitor apparatus, both end terminals of the compensation coil are connected to a compensation current supply circuit of the monitor apparatus. In contrast, the manufacturing inspection special adjustment apparatus does not include any compensation current supply circuit equivalent to that of the monitor apparatus, and both end terminals of its compensation coil are open during inspections manufacturing. Therefore, an adjustment of the color cathode ray tube installed in the monitor apparatus is different from an adjustment carried out during manufacturing inspections, so that convergence and landing of three electron beams with respect to three color phosphor layers are different between both adjustments. As a result, adjustment services are complicated, leading to low operation efficiency.

BRIEF SUMMARY OF THE INVENTION

The present invention has been made in view of the above situation, and its object is to provide a deflection apparatus for a cathode ray tube, which can adjust convergence of three electron beams and landing thereof on phosphor layers in the manner as by a monitor apparatus, without particularly changing an adjustment apparatus used for manufacturing inspections and without reducing operation efficiency of adjustment of convergence and landing of three electron beams with respect to three color phosphor layers.

In order to achieve the above object, according to the present invention, a deflection apparatus for a cathode ray tube which comprises an envelope having a funnel and a face panel with a phosphor screen formed on an inner surface of the face panel, and an electron gun assembly provided in a neck portion of the funnel, for emitting electron beams onto the phosphor screen, comprises:

a deflection yoke arranged on an outer circumference of the funnel, for deflecting electron beams emitted from the electron gun assembly, in horizontal and vertical directions, the deflection yoke having front and rear end opening portions; a compensation coil provided near either one of the front and rear end opening portions of the deflection yoke, for compensating a shift of convergence of the electron beams and a shift of landing positions of the electron beams on the phosphor screen; and an electrostatic capacitance element connected between both end terminals of the compensation coil, for reducing an inducing voltage generated between both end terminals, to be equal to or lower than a predetermined value.

According to the deflection apparatus constructed as described above, an inducing voltage generated between both end terminals of the compensation coil is reduced to a predetermined value or lower, by the electrostatic capacitance element. Therefore, it is possible to prevent convergence and landing of electron beams from being shifted under influences from the magnetic field generated from the compensation coil due to the inducing voltage.

Further, according to the present invention, the capacity of the electrostatic capacitance element is set such that the inducing voltage generated between both end terminals of the compensation is 20V or lower and is preferably within a range of 0.1 to 10V.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 1 to 5 show a color cathode ray tube comprising a deflection apparatus according to an embodiment of the present invention, in which:

FIG. 1 is a side view showing the color cathode ray tube partially cut away, FIG. 2 is a side view showing the deflection apparatus, FIG. 3 is a front view showing a compensation coil of the deflection apparatus, FIG. 4 is a circuit diagram of the compensation coil, and FIG. 5 is a circuit diagram of the compensation coil connected to a compensation current supply circuit in a monitor apparatus;

DETAILED DESCRIPTION OF THE INVENTION

An embodiment of the present invention will now be described in detail with reference to the accompanying drawing.

Figure 1:
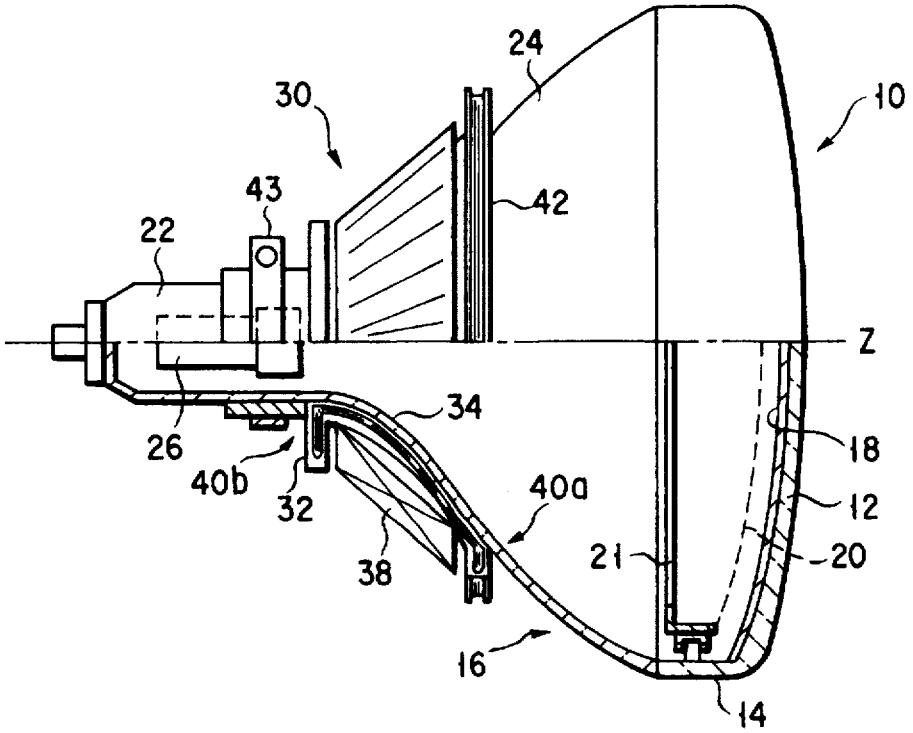

FIG. 1 shows a color cathode ray tube comprising a deflection apparatus according to an embodiment of the present invention. The color cathode ray tube comprises a vacuum envelope 10. This vacuum envelope has a substantially rectangular face panel 12 having a skirt portion 14 erected on the periphery of the face panel and a funnel 16 fixed to the skirt portion 14. On the inner surface of the face panel 12 is formed a phosphor screen 18 formed of phosphor layers of three colors which radiate in red, blue, and green. Also inside the face panel 12, a shadow mask 20 is provided so as to face the phosphor screen 18. The shadow mask 20 is supported on the skirt portion 14 through the mask frame 21.

The funnel 16 includes a cylindrical neck 22 having a small diameter and a corn portion 24 whose diameter increases from the neck 22 toward the face panel 12 and which has a substantially rectangular cross section. The neck 22 and corn portion 24 are integrally formed of glass. Further, the funnel 16 is connected to the face panel 12, with the opened end of the corn portion 24 kept touched with the skirt portion 14. In the neck 22, there is provided an electron gun 26 for emitting three electron beams R, G, and B toward the phosphor screen 18. On the outer circumference of the boundary area between the neck 22 and the corn portion 24 of the funnel 16, a deflection apparatus 30 for deflecting electron beams emitted from the electron gun 26 to scan in the horizontal and vertical directions is arranged to be coaxial with the tube axis Z of the vacuum envelope 10.

Figure 2:
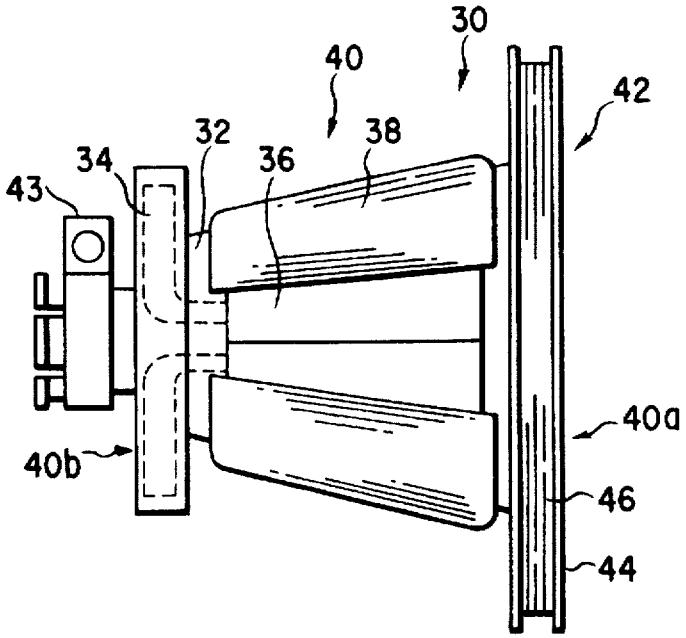

As shown in FIGS. 1 and 2, the deflection apparatus 30 comprises a deflection yoke (semi-toroidal type deflection yoke) 40 which has front and rear end opening portions 40*a* and 40*b* and which is tapered as a whole. This yoke 40 includes a tapered separator 32 made of synthetic resin whose diameter is small in the side of the neck 22 and is large in the side of the corn portion 24, a pair of upper and lower saddle type horizontal deflection coils 34 arranged inside the separator, and a pair of toroidal type vertical deflection coils 38 arranged outside the separator 32 and wound around a core 36. A tightening band 43 for fixing the deflection apparatus 30 to the funnel 16 is installed on the outer circumference of an end portion of the separator 32 in its small diameter side.

Figure 3:
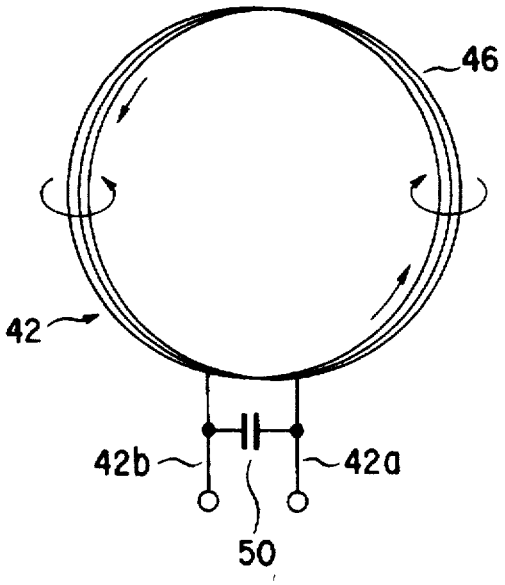

Further, the deflection apparatus 30 comprises a compensation coil 42 provided outside the front end opening portion 40*a*, for compensating shifts of convergence and landing of electron beams on the three phosphor layers. The compensation coil 42 includes a ring-like coil bobbin 44 fitted on the outer circumference of the front end of the separator 32 and a coil 46 wound within a groove of the coil bobbin 44. As shown in FIG. 3, a electrostatic capacitance element 50 is connected between both end terminals 42*a* and 42*b* of the compensation coil 42.

Figure 4:
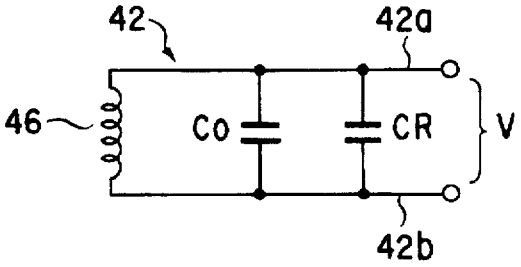

The capacity of the electrostatic capacitance element 50 is determined by a reactance L, a resistance R, a capacitance C, and a transconductance M between the horizontal deflection coils 34 and the vertical deflection coils 38 of the compensation coil 42, and is set to about 2,200 PF, for example. More specifically, when the compensation coil 42 is applied with magnetic flux from the horizontal deflection coils 34 and vertical deflection coils 38, the compensation coil generates an electromotive force in accordance with Faraday's law. As shown in FIG. 4, the coil 46 has a slight capacity $C_0$ such as a lead line and the likes, and therefore forms a closed circuit thereby generating an inducing voltage V. Due to the inducing voltage V, the compensation coil 42 generates a magnetic field in the tube axis direction Z. In accordance with Fleming's rule, a force in the vertical direction caused by the magnetic field acts on the electron beams emitted from the electron gun 26, thereby shifting the electron beams.

Hence, according to the present embodiment, an electrostatic capacitance element 50 ($C_R$) is connected between both end terminals of the coil 46, and the capacity of this electrostatic capacitance element 50 is set to a value with which the above-mentioned inducing voltage V is sufficiently decreased. Therefore, the difference between the inducing voltage generated in the compensation coil 42 when its end terminals are opened and the inducing voltage generated in the compensate coil 42 when its end terminals are connected to a compensation current supply circuit 56 (described later) in the monitor apparatus can be reduced. Accordingly, the magnetic field generated from the compensation coil 42 due to the inducing voltage is reduced to prevent undesirable influences on the electron beams.

For example, the capacity of the electrostatic element 50 is set such that the inducing voltage V is 20V or lower, desirably 0.1 to 10V. In case where the capacity of the electrostatic capacitance element 50 is set to 2200 pF or higher, the inducing voltage caused by magnetic flux from the horizontal deflection coils 34 can be decreased to 2.0V or lower, and the inducing voltage caused by magnetic flux from the vertical deflection coils 38 can be decreased to 10V or lower, so that convergence shifts and landing shifts of the electron beams due to the inducing voltage can be substantially eliminated.

Figure 5:
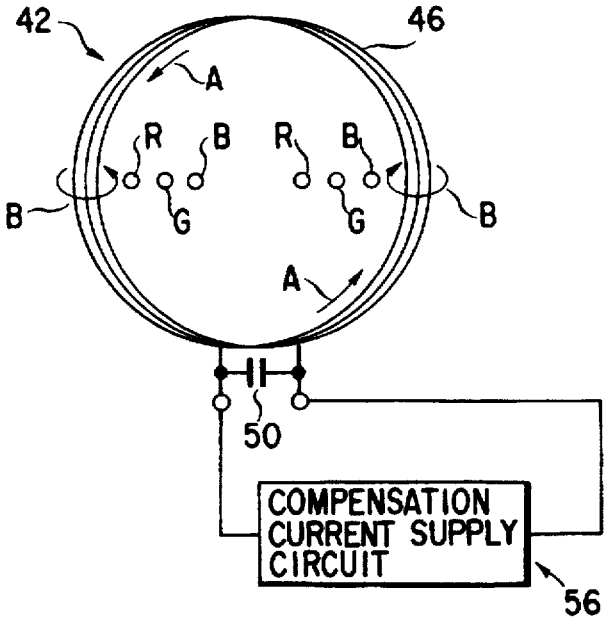

When the color cathode ray tube constructed as described above is installed in a monitor apparatus, both end terminals 42*a* and 42*b* of the compensation coil 42 are connected to a compensation current supply circuit 56, as shown in FIG. 5. Further, a magnetic field indicated by an arrow B is generated around the coil 46, by a current supplied from the compensation current supply circuit. Convergence shifts and landing shifts of the electron beams are compensated by this magnetic field.

Figure 6A:
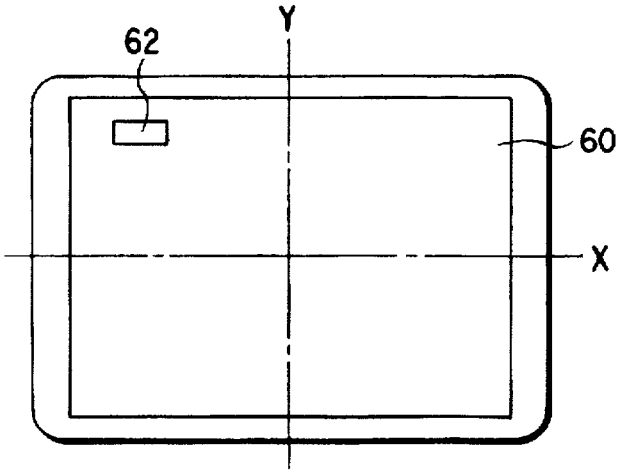
FIGS. 6A and 6B are schematic views respectively showing a raster and an electron beam landing state both properly adjusted.
Figure 6B:
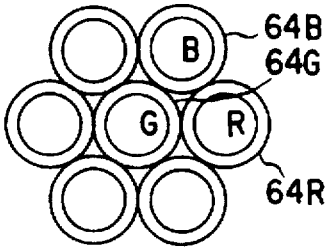
Figure 7A:
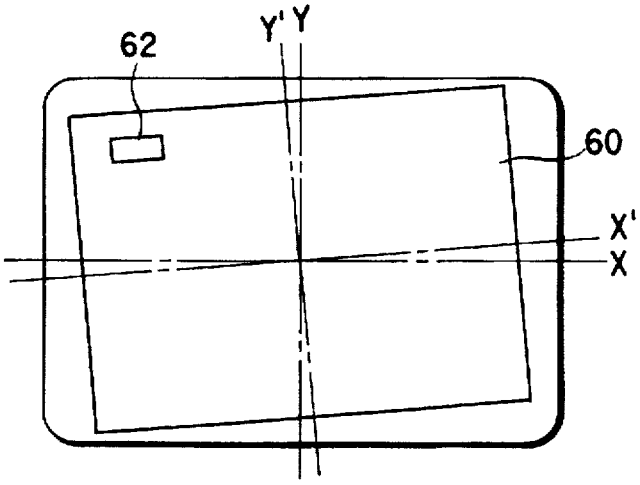
FIGS. 7A and 7B are schematic views respectively showing a raster and an electron beam landing state both rotationally shifted in the counter-clockwise direction.
Figure 7B:
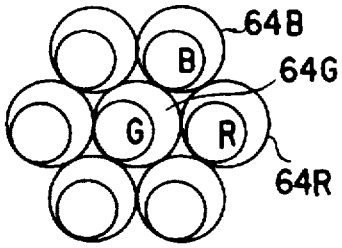
Figure 8A:
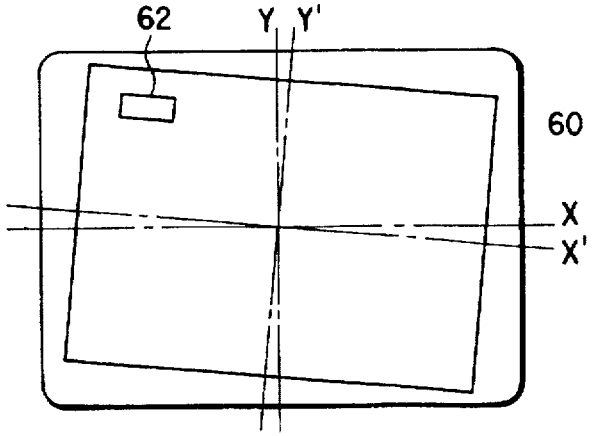
FIGS. 8A and 8B are schematic views respectively showing a raster and an electron beam landing state both rotationally shifted in the clockwise direction.
Figure 8B:
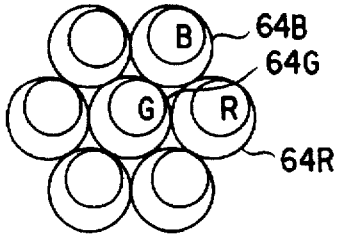

FIG. 6A shows a normal raster 60 after compensation and FIG. 6B shows landing of three electron beams on phosphor layers 64B, 64G, and 64R of three colors in a region 62 in the raster 60. When the color cathode ray tube thus properly adjusted is arranged such that the component of earth magnetism in the tube axis direction Z penetrates the tube from its back surface toward its front surface, the raster 60 is rotationally shifted in the counter-clockwise direction as shown in FIG. 7A, and landing positions of three electron beams B, G, and R on three color phosphor layers 64B, 64G, and 64R are rotationally shifted in the counter-clockwise direction. Further, when the color cathode ray tube properly adjusted is arranged such that the component of earth magnetism in the tube axis direction Z penetrates the tube from its front surface toward its back surface, the raster 60 is rotationally shifted in the clockwise direction as shown in FIG. 8A, and landing positions of three electron beams B, G, and R on three color phosphor layers 64B, 64G, and 64R are rotationally shifted in the clockwise direction.

If rotational shifting of the raster 60 and three electron beams is thus caused, a magnetic field B is generated by supplying a compensation current A (of a direct current) to the compensation coil 42 of the deflection apparatus 30 from the compensation current supply circuit 56, so that three electron beams B, G, and R are applied with a compensation force corresponding to the direction and the current amount of the compensation current A flowing through the compensation coil 42 (according to Fleming's rule), thereby compensating rotational shifts of the raster 60 and the landing positions caused due to the component of earth magnetism in the tube axis direction Z.

According to the color cathode ray tube constructed as described above, an inducing voltage V generated between both end terminals 42*a* and 42*b* of the compensation coil 42 can be reduced by connecting an electrostatic capacitance element 50 between both end terminals 42*a* and 42*b* of the compensation coil 42 for compensating convergence shifts and landing shifts of three electron beams with respect to three color phosphor layers. Therefore, a resonance between the deflection magnetic field generated by the deflection yoke 40 and the magnetic field generated by the compensation coil 42 whose end terminals are opened can be substantially equal to that between the deflection magnetic field generated by the deflection coil 40 and the magnetic field generated by the compensation coil 42 whose end terminals are connected to the compensation current supply circuit 56. As a result, convergence adjustment of three electron beams and landing adjustment thereof with respect to three color phosphor layers during manufacturing inspection become equivalent to those to be carried out after the color cathode ray tube is installed in a monitor apparatus.

Figure 9:
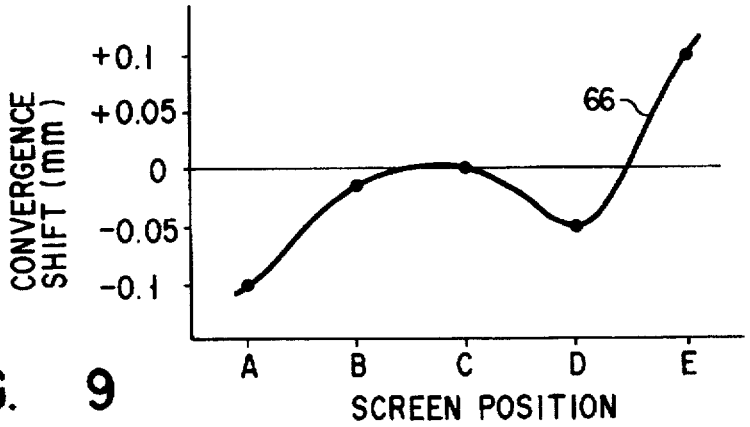
FIG. 9 is a graph showing a convergence shift amount of electron beams, as a comparison example, in a deflection apparatus in which an electrostatic capacitance element is not connected to the compensation coil.
Figure 10:
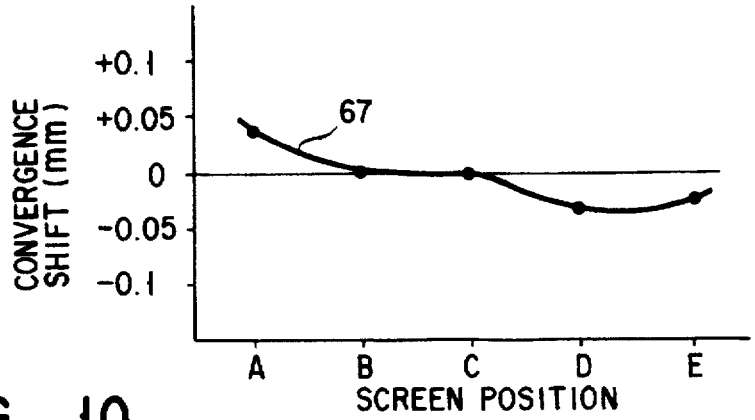
FIG. 10 is a graph showing a convergence shift amount of electron beams in the deflection apparatus according to the above-mentioned embodiment.

More specifically, when an electrostatic capacitance element is not connected between the end terminals of the compensation coil 42 as indicated by a curve 66 in FIG. 9, a convergence shift of a red electron beam relative to a blue electron beam as a standard reference increases both in the left-hand and right-hand end portions A and E of the screen. However, when an electrostatic capacitance element 50 is connected between the end terminals 42*a* and 42*b* of the compensation coil 42, as indicated by a curve 67 in FIG. 10 according to the present embodiment, convergence shifts can be reduced not only in center portions B, C, and D of the screen but also in the left-hand and right-hand end portions A and E of the screen, in comparison with the above case in which an electrostatic capacitance element is not connected. Thus, adjustments carried out during manufacturing inspection by a special adjustment apparatus become substantially equivalent to adjustments carried out with the color cathode ray tub installed in a monitor apparatus.

Therefore, it is possible to provide a deflection apparatus for a cathode ray tube, by which convergence of a plurality of electron beams and landing thereof on phosphor layers can be adjusted in the manner as by a monitor apparatus, without particularly changing the adjustment apparatus used in inspections in steps of manufacturing a color cathode ray tube and without reducing operation efficiency of adjustment of convergence and landing of three electron beams with respect to three color phosphor layers.

Note that the present invention is not limited to the above-mentioned embodiment, but can be variously modified within the scope of the present invention. For example, the compensation coil is provided on the outer circumference of the opening portion of the front end of the deflection yoke, in the above embodiment. However, a deflection apparatus with same advantages can be obtained even if the compensation coil is provided on the outer circumference of the rear end of the deflection yoke.

Further, the above embodiment has been explained with respect to a deflection apparatus comprising a semi-toroidal type deflection yoke. The present invention, however, may be applied to a deflection apparatus comprising a deflection yoke of another type than the semi-toroidal type.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

We claim:

1. A deflection apparatus for a cathode ray tube including an envelope having a funnel and a face panel with a phosphor screen formed on an inner surface of the face panel, and an electron gun assembly arranged in a neck portion of the funnel, for emitting electron beams onto the phosphor screen, said deflection apparatus comprising:

a deflection yoke arranged on an outer circumference of the funnel, for deflecting electron beams emitted from the electron gun assembly, in horizontal and vertical directions, the deflection yoke having front and rear end opening portions;

a compensation coil arranged near either one of the front and rear end opening portions of the deflection yoke, for compensating a shift of convergence of the electron beams and a shift of landing of the electron beams on the phosphor screen due to earth magnetism; and an electrostatic capacitance element connected between both end terminals of the compensation coil, for reducing an inducing voltage generated between both end terminals due to a deflection magnetic field generated by the deflection yoke, to be equal to or lower than a predetermined value.

2. A deflection apparatus according to claim 1, wherein the electrostatic capacitance element has a capacity set such that the inducing voltage generated between both end terminals of the compensation coil is 20V or lower.

3. A deflection apparatus according to claim 2, wherein the electrostatic capacitance element has a capacity set such that the inducing voltage generated between both end terminals of the compensation coil is within a range of 0.1 to 10V.

4. A deflection apparatus according to claim 1, wherein the compensation coil is arranged around either one of the front and rear opening portions and coaxial with the neck of the funnel.

* * * * *